US007151427B2

(12) United States Patent
Muller et al.

(10) Patent No.: US 7,151,427 B2
(45) Date of Patent: Dec. 19, 2006

(54) SEALED-OFF SWITCHGEAR

(75) Inventors: Michael Muller, Bexbach (DE); Heinz Jacobus, Dudweiler (DE); Matthias Stitz, Lohr (DE); Bruno Schneider, Fellen (DE)

(73) Assignees: Hydac Electronic GmbH, Saarbrücken (DE); Bosch Rexroth AG, Stuttgart (DE)

( * ) Notice: Subject to any disclaimer, the term of this patent is extended or adjusted under 35 U.S.C. 154(b) by 273 days.

(21) Appl. No.: 10/470,973

(22) PCT Filed: Jan. 24, 2002

(86) PCT No.: PCT/EP02/00677

§ 371 (c)(1),
(2), (4) Date: Nov. 25, 2003

(87) PCT Pub. No.: WO02/063643

PCT Pub. Date: Aug. 15, 2002

(65) Prior Publication Data

US 2004/0089833 A1 May 13, 2004

(30) Foreign Application Priority Data

Feb. 3, 2001 (DE) ..... 101 04 998

(51) Int. Cl.
*H01F 27/03* (2006.01)
*H01F 7/00* (2006.01)

(52) U.S. Cl. ..... 335/278; 335/282; 336/90; 336/96; 336/107; 336/192

(58) Field of Classification Search ..... 439/736, 439/722; 336/90, 96, 107, 192; 335/278, 335/282, 299

See application file for complete search history.

(56) References Cited

U.S. PATENT DOCUMENTS

| | | | | |
|---|---|---|---|---|
| 6,175,168 | B1 | 1/2001 | Budd et al. | |
| 6,737,947 | B1 * | 5/2004 | Volckmann et al. | 336/90 |
| 6,838,969 | B1 * | 1/2005 | Suda | 336/90 |
| 6,966,800 | B1 * | 11/2005 | Mott | 439/722 |
| 2004/0018780 | A1 * | 1/2004 | Mott et al. | 439/722 |

FOREIGN PATENT DOCUMENTS

| | | |
|---|---|---|
| DE | 8317753 | 11/1984 |

(Continued)

*Primary Examiner*—Ramon M. Barrera
(74) *Attorney, Agent, or Firm*—Roylance, Abrams, Berdo & Goodman, L.L.P.

(57) ABSTRACT

A switchgear, especially for actuating valves, includes a housing (18) and a coil body (10) disposed in the housing. A switch element is guided in the coil body. The coil body is provided with a winding (14) of a conductor (16) that is connected to a plug connector (22) via contact elements (20). At least some sections of the housing (18) and of the plug connector (22) are enclosed by a plastic compound (24). Sealing devices (40) seal off the interior (42) of the switchgear from the surroundings (44). At least one of the sealing devices (40) is configured as a sealing web (48) of a meltable material. The sealing web (48) is disposed on the bottom face (50) of a plug plate (26) of the plug connector (22) which faces the housing (18). The sealing web (48), in the molten connection state, seals off at least the engaging parts of the plug connector (22) that are connected to the housing (18) from the surroundings (44) in a fluid-tight manner by the plastic compound (24), thereby eliminating the need for conventional rubber packing rings (O rings) in the area of the plug connector that are prone to failures.

13 Claims, 2 Drawing Sheets

FOREIGN PATENT DOCUMENTS

| | | |
|---|---|---|
| DE | 3635551 | 4/1988 |
| DE | 4106761 | 9/1992 |
| DE | 4341087 | 6/1995 |
| DE | 19854100 | 5/2000 |
| DE | 19960306 | 6/2000 |
| FR | 1348792 | 12/1963 |
| JP | 10270240 | 10/1998 |

* cited by examiner

SEALED-OFF SWITCHGEAR

FIELD OF THE PRESENT INVENTION

The present invention relates to a sealed-off switchgear, especially for actuating valves, comprising a housing and a coil element mounted in this housing. A switching component is conducted and is provided with a winding of a conductor which is connected to the contact components of an attaching plug. At least some parts of the housing and of the attaching plug are surrounded by a plastic material and means sealing the interior of the switching device from the environment.

BACKGROUND OF THE INVENTION

Switching devices, such as switchgears, are also designated as switching magnets, are disclosed, for example, in DE 36 35 551 A1 and DE-GM 83 17 753, and are readily obtainable on the market. The switching component is made up essentially of a tubular bolt which, when the coil undergoes electric excitation, traverses a predetermined path to the plug receptacle of a connector plate, thereby initiating a switching process, for example, in the case of a valve blocking and allowing the passage of fluid flows. If such switching devices are used in areas of high humidity, such as occurs among other situations in formation of condensate, the moisture advances to the interior of the housing, and especially to the coil element with the winding. The moisture leads to disabling of the switching device as corrosion occurs. While it has already been proposed to avoid this problem by enclosing the housing of the switching device entirely in a plastic sealing compound providing protection from moisture, this proposal results in an overly large switching device ill suited for use in automotive technology (mobile technology), where in essence only little installation space is available.

FR 1 348 792 proposes using rubber sealing rings (O rings) mounted on the end in seats of housing covers of the switching device and between the housing and the plug receptacle of the connector plate to effect sealing potential points of entry of moisture into the housing, rather than by sealing a plastic sealing compound. In this instance as well, however, it has been found that the sealing from penetration of moisture, in particular in the area of the plug connector of the connector plate, is not satisfactory. Embrittlement of the sealing rings, which may accompany aging of the switching device, results in complete destruction of the sealing effect.

Another magnetic coil configuration is disclosed in DE 198 54 100 A1. An encapsulated coil with a spray-applied plug socket is provided for connection of electric connection leads. A metal housing encloses the encapsulated coil. The contact lug associated with the protective lead connection extends through the plug socket, and is connected to the metal housing. To prevent entry of moisture into the sealed space of the plug socket as a result of capillary action between the contact lug and the plastic enclosing it, a recess is provided between the plug socket and the outer surface of the encapsulated coil, into which the metal housing is introduced. A connecting element, which effects electric connection of the contact lug with the metal housing, extends through the recess inside the plug socket. A sealing element enclosing the connecting element is mounted in the recess in the plug socket. Magnetic coil configurations such as this are employed in industrial hydraulics for actuation of electromagnetically operated hydraulic valves in which metal parts accessible from the exterior are to be connected to a grounded lead connection.

For a generic switching device disclosed in DE 43 41 087 C2, an attempt has been made to solve this problem where the plug receptacle has a contact surface for application of an annular sealing component. The contact surface projects a predetermined axial distance beyond the bottom of the connector plate facing the external circumference of the housing. When installation has been completed, at least the gap between connector plate and the external circumference of the housing is closed to effect sealing by applying pressure to the annular rubber sealing element. In this way, moisture can no longer reach the interior of the housing, and in particular the coil element with the winding. This solution is costly to implement. The parts in question must interact with minimal tolerances, something which appreciably increases manufacturing complexity and consequently manufacturing costs. In addition, since a rubber sealing ring is used, when the switching device is in service over a long period failure from embrittlement or loosening of the sealing ring in question cannot be excluded.

SUMMARY OF THE INVENTION

Objects of the present invention are to provide a compact switching device suitable, in particular for use in automotive technology, and permitting a long period of reliable operation even in high humidity.

These objects are attained by a switching device according to the present invention where at least one of the sealing means is in the form of a sealing strip. The sealing strip is of a fusible material applied at a temperature such that the sealing strip melts with the plastic material to effect sealing from fluids, is mounted on the bottom of a plug receptacle of the plug connector facing the housing, and seals fluid tight from the environment, when melted and joined with the plastic material. At least the contact components of the plug connector are connected to the housing. The use of conventional rubber sealing rings (O rings), that are subject to failure, may be completely eliminated in the areas of the plug connector. Thermal fusion of the sealing strip to the plastic sealing compound results in homogenous fusion of material components facing each other, ensuring dependable sealing of the operating parts from the environment even in high humidity or penetration by condensate and ensuring dependable operation of the switching device even over very long periods of use. Since the sealing strip is distinctly compact, the sealing strips produced occupy no structural space or only a small such space. The sealing sections produced are themselves in turn small or occupy only a small structural space, so that the switching device as a whole or the switching magnet may be configured to be structurally small. Since the switching device is extrusion-coated with the plastic sealing compound, sealing of the device by the extrusion coating proper or casting integral with the plastic compound can be accomplished in one process step, something which appreciably simplifies production and lowers production costs. Consequently, the costly additional insertion of sealing rings and precise positioning of these rings inside the switching device in the area of the attaching plug may be completely eliminated.

The sealing strip is mounted on the bottom of a connector plate of the attaching plug facing the housing. At least of the contact components of the plug connector which are connected to the housing, when the sealing strip is in the melted connection state with the plastic compound, are fluid-tight sealed from the environment. The sealing strip preferably is a one-piece component of the plug receptacle. This structure provides a reliable, simple sealing option without the need for first carrying out precise adjustment steps for axial pressing of the conventional rubber sealing rings to the bottom of the plug receptacle as in DE 43 41 087 C2.

Free space or a gap exists between the sealing strip and the housing or between the housing and the attaching plug. In extrusion coating by means of the hot plastic compound, the latter coating reaches the sealing strip unimpeded and flows around it on all sides until it is sealed off. Improved flow behavior is achieved for the plastic compound itself in jacketing of the switching device or essential parts of the latter. This flow behavior is favorable from the viewpoint of manufacturing technology. The use of additional sealing means in the form of rubber sealing rings or the like may be eliminated as a result of the sealing strip in the form of the fused strip in conjunction with the process of fusion with hot plastic compound.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
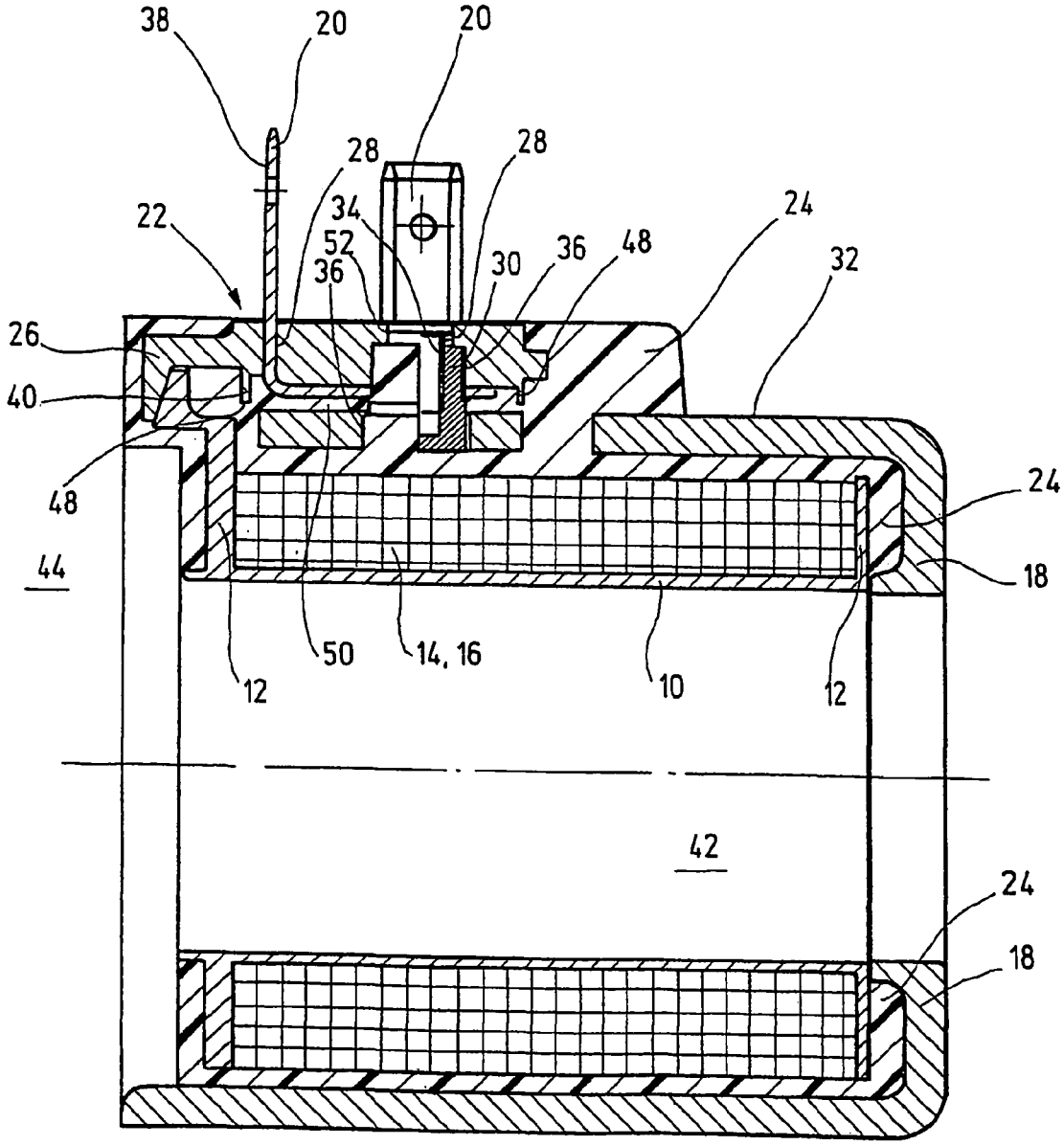
FIG. 1 is a side elevational view in section of a switching device according to an embodiment of the present invention, without a polar tube and without a switching component, and with the fusion strip being shown appreciably enlarged.

The switching device of the illustrated embodiment of the present invention has a coil element 10 of plastic material. The coil element 10 has on the end two annular frontal flanges 12 between which extends the winding stack 14 of a conductor 16, which in FIG. 1 is shown only in diagrammatic form. A switching component (not shown) is introduced into coil element 10, and is surrounded by a so-called polar tube (not shown). The configuration of the switching component and polar tube are conventional, and accordingly, will not be discussed in greater detail at this point. However, the switching component may be used in actuation of the switching device to operate conventional valves, and thus, to determine their switched position.

The coil element 10 is enclosed in a more or less cylindrical housing 18 of a metal material. The conductor 16 of the winding 14 is in contact with contact components (20) in the form of three plug lugs of an attaching plug 22 so as to conduct electricity. The details of the respective connection technology between the conductor 16, the winding 14, and the electrically conducting components of the attaching plug 22 are presented in particular in FIG. 2 of DE 43 41 087 C2 and accordingly will not be discussed in greater detail at this point.

A plastic compound 24, especially one in the form of a plastic sealing compound, is employed for electric insulation of the parts of the housing 18, the winding 14, and conducting parts of the plug connector 22. This compound may be injected at an elevated temperature into the gaps between those parts and sets there. An integral casting or integral extrusion mold (not shown) into which the parts of the switching device may be introduced serves the purpose of integral extrusion of the switching device itself with the plastic compound 24.

Figure 2:
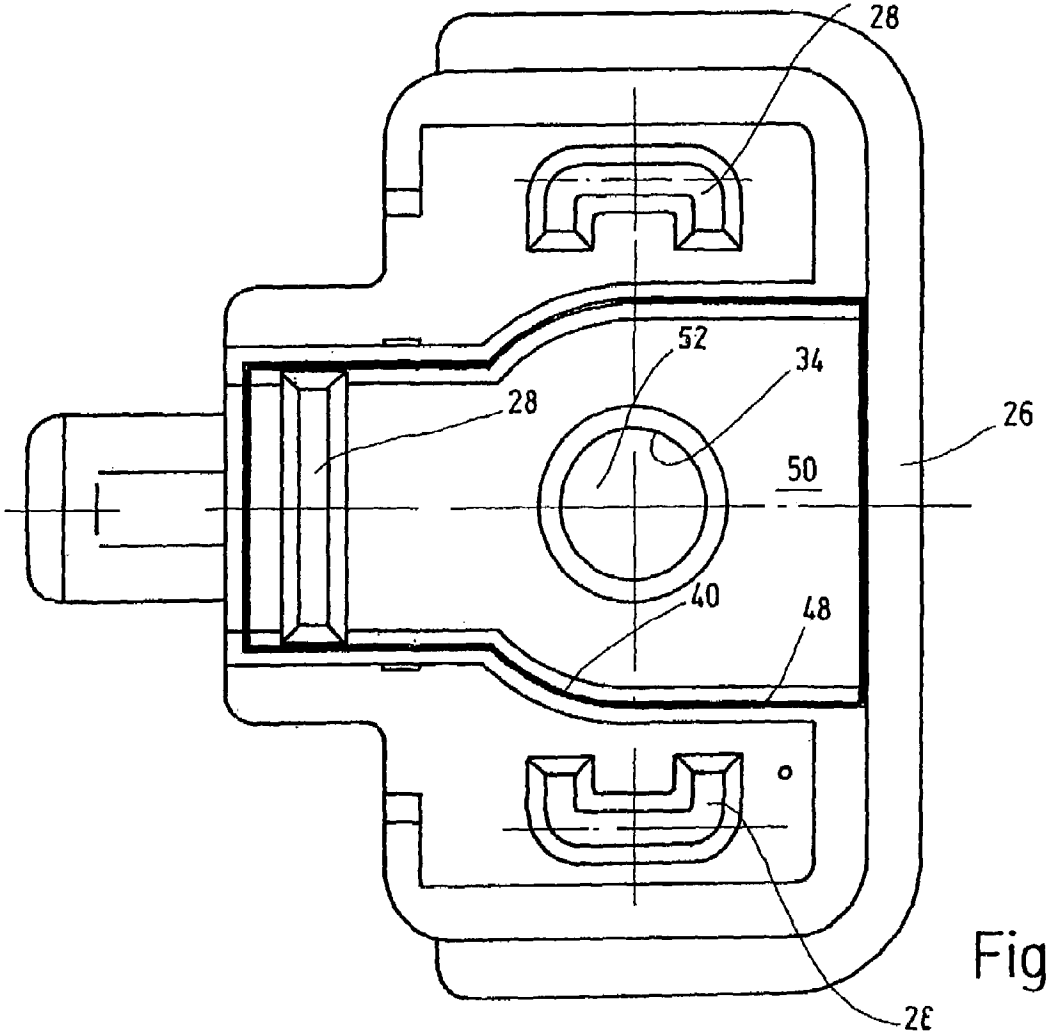
FIG. 2 is a bottom plan view of a plug component of the attaching plug with no plug components introduced, of the switching device of FIG. 1.

The contact components 20 in the form of the three plug lugs may be cut or stamped from a level blank, and are then integrally molded with the plastic material of the connecting plug 22 in the form of the plug receptacle 26. The respective plug receptacle 26 is shown in FIG. 2, as seen from the bottom. The plug lugs are omitted for the sake of greater simplicity of illustration. Only the three openings 28 in the plug receptacle 26 are shown through which extend the contact components 20 in the form of the plug lugs. The plug receptacle 26 has more or less in the center a connection insert 30 which is in the form of a bushing. By this connection insert 30, the plug receptacle 26 may be positioned on the external circumference 32 of the housing 18 with proper spacing maintained. In addition, the connection insert 30 has an internal screw thread 34 and two edge inserts 36 axially spaced from each other, each of which is provided with longitudinal teeth. The edge inserts 36 ensure firm holding of the connection insert 30 both in the metal housing 18 and in the plug receptacle 26 by its plastic material.

The internal screw thread 34 is part of a screw connection into which the plug receptacle 26 is introduced for the purpose of current connection together with an appliance plug (not shown). The connection insert 30 is connected to the contact component 20 of the plug receptacle 26 serving as ground connection 38, and in particular extends conductively through the ground connection 38. To effect connection of the plug receptacle 26 to the housing 18, preferably the connection insert 30 is first introduced into the plug receptacle 26 and is then pressed together with it against the housing 18, at least until secure retention of the lower part of the edge insert 36 in the housing 18 is ensured. The housing 18, the coil element 10, and the winding 14 are configured as more or less rotation-symmetrical components. The plastic sealing compound 24 is shown cross-hatched in FIG. 1, and indicates the compound-filled spaces and gaps in the switching device. In addition to electric insulation, the plastic compound 24 in essence also ensures that moisture, in the form of condensate or the like, cannot penetrate the switching device. The possibility is not to be excluded, however, that moisture may penetrate the switching device as a result of capillary action which occurs in particular between the connecting surface of the plastic compound 24 and the other parts of the switching device, such as the housing 18 or the parts of the plug receptacle 26. Additional sealing means 40 to seal the interior 42 from the environment 44 (see FIG. 1) are provided to remedy the problem of the capillary action in question.

The sealing means 40 is made up of a sealing strip 48. This sealing strip 48 is formed of a fusible material. When the plastic compound 24 is applied, this material is at a temperature such that the respective sealing strip 48 fuses fluid-tight with the plastic mass 24. To permit illustration of the sealing strip 48, the latter is shown graphically in FIG. 1, although the plastic mass 24 has in this situation already been introduced into the switching device proper. The sealing strip 48 accordingly forms a closed sealing ring with the plastic compound 24 itself in advance of the fusion.

The sealing strip 48 is mounted on the bottom 50 of the plug receptacle 26 of the attaching plug 22 facing the housing 18. This sealing strip 48 seals at least the contact components connected to the housing 18 of the attaching plug 22 in the form of the sleeve-like connection insert 30, when in the fused connection state with the plastic compound 24, fluid-tight from the environment 44. As is shown by FIG. 2 in particular, the sealing strip 48 is an integral component of the plug receptacle 26 and projects a predetermined distance beyond the bottom 50 of the plug receptacle plate. As is shown by FIG. 2 in particular, the sealing strip 48 is in the form of a circumferential sealing edge. The sealing strip 48 is self-contained, and includes between its sealing edges the boring 52 receiving the connection insert 30 when assembly has been completed. In addition, the sealing strip 48 separates the respective connection insert 30 from the two current-conducting lugs as contact components 20, while the ground connection 38 is situated inside the sealing strip 48 and extends through the associated opening 28. To this extent, separation of the ground connection 38 from the two current-conducting contact plugs 20 is effected by the sealing edge in the form of the sealing strip 48. This sealing strip is in the form of a fused ring or fused strip which melts as soon as it comes in contact with the hot integrally extruded compound and forms an integral connection with the plastic compound 24. The sealing strip 48 is preferably also formed of a thermoplastic material similar to the plastic compound 24, and more preferably of a polyamide material.

As the illustrations show, the sealing strip 48 may be rectangular in cross-section. However, a triangular cross-sectional shape or other cross-sectional shapes (not shown) are also possible without impairing the sealing effect. In addition, the sealing strip 48 selected may be configured to be structurally very small, for example, with a width of 0.2 to 0.3 mm and a height of 0.3 to 0.4 mm.

The materials selected are to be such that, for example, the plastic of the coil element 10 has a melting point lower than that of the plastic compound 24, so that melting on the sealing strip 48 is in any event ensured by the integrally extruded compound. The same applies to selection of the plastic for the attaching plug 22.

While one embodiment has been chosen to illustrate the invention, it will be understood by those skilled in the art that various changes and modifications can be made therein without departing from the scope of the invention as defined in the appended claims.

What is claimed is:

1. A sealed-off switchgear, comprising:

a housing;

a coil element mounted in said housing to conduct a switching component therein and having a winding with a conductor;

an attaching plug having at least parts thereof enclosed in a plastic compound with at least parts of said housing, having a plug receptacle and having contact components connected to said conductor; and a sealing strip of a fusible material mounted on a bottom of said plug receptacle facing said housing and sealing at least said contact components in a fluid-tight manner from an environment when fused with said plastic compound.

2. A sealed-off switchgear according to claim 1 wherein said sealing strip forms a closed ring prior to fusion with said plastic compound.

3. A sealed-off switchgear according to claim 1 wherein said sealing strip is an integral component of said plug receptacle.

4. A sealed-off switchgear according to claim 1 wherein said sealing strip is formed of thermoplastic material.

5. A sealed-off switchgear according to claim 1 wherein said sealing strip is rectangular in cross section.

6. A sealed-off switchgear according to claim 1 wherein said sealing strip is triangular in cross section.

7. A sealed-off switchgear according to claim 1 wherein said plastic compound is an integral extrusion.

8. A sealed-off switchgear according to claim 7 wherein said plastic compound is a thermoplastic.

9. A sealed-off switchgear according to claim 8 wherein said thermoplastic is polyamide.

10. A sealed-off switchgear according to claim 1 wherein said sealing strip and said plastic compound are formed of similar thermoplastic materials.

11. A sealed-off switchgear according to claim 10 wherein said thermoplastic materials are polyamides.

12. A sealed-off switchgear according to claim 1 wherein said sealing strip has a melting temperature not greater than that of said plastic compound.

13. A sealed-off switchgear according to claim 1 wherein said sealing strip extends from said bottom in a direction parallel to said contact components.

* * * * *